United States Patent [19]

Ito et al.

[11] Patent Number: 4,632,581

[45] Date of Patent: Dec. 30, 1986

[54] SERIAL PRINTER HAVING TRIGGER MECHANISM

[75] Inventors: Kiyoshi Ito; Taro Takekoshi, both of Shiojiri, Japan

[73] Assignee: Seiko Epson Corporation, Suwa, Japan

[21] Appl. No.: 670,699

[22] Filed: Nov. 13, 1984

[30] Foreign Application Priority Data

| | | | |
|---|---|---|---|
| Nov. 10, 1983 | [JP] | Japan | 58-211657 |
| May 11, 1984 | [JP] | Japan | 59-94923 |
| May 22, 1984 | [JP] | Japan | 59-102846 |

[51] Int. Cl.[4] ..... B41J 1/46; B41J 1/54

[52] U.S. Cl. ..... 400/187; 400/145.2; 400/257; 101/93.21; 101/93.36

[58] Field of Search ..... 400/145.2, 146, 257, 400/145, 145.1, 147, 148, 185, 186, 187, 154.1, 154.4, 154.5, 155.1; 101/93.15, 93.16, 93.17, 93.18, 93.21, 93.26, 93.28, 93.35, 93.36; 178/34, 35, 40, 33 A

[56] References Cited

U.S. PATENT DOCUMENTS

| | | | |
|---|---|---|---|
| 954,489 | 4/1910 | Wright | 178/33 A |
| 3,120,801 | 2/1964 | Davies et al. | 101/93.29 |
| 3,780,845 | 12/1973 | Boyden | 400/257 X |
| 4,239,400 | 12/1980 | Giolitti | 400/144.2 |
| 4,352,576 | 10/1982 | Hori et al. | 400/154.4 |
| 4,423,972 | 1/1984 | Inoue et al. | 400/155 |
| 4,436,031 | 3/1984 | Hori | 400/185 |
| 4,437,777 | 3/1984 | Hori | 400/154.2 |

FOREIGN PATENT DOCUMENTS

| | | | |
|---|---|---|---|
| 57-109677 | 7/1982 | Japan . | |
| 57-173188 | 10/1982 | Japan . | |
| 195672 | 12/1982 | Japan | 400/146 |

*Primary Examiner*—Charles Pearson
*Attorney, Agent, or Firm*—Blum Kaplan

[57] ABSTRACT

A type wheel stack, a typewheel mounting shaft and a motor are arranged on a movable carriage. The type wheel arrangement is rotatable with and axially movable along the shaft. The motor is coupled to the type wheel stack through a clutch and cam mechanism to both rotate and axially shift the type wheels in order to select a desired character to be printed.

35 Claims, 27 Drawing Figures

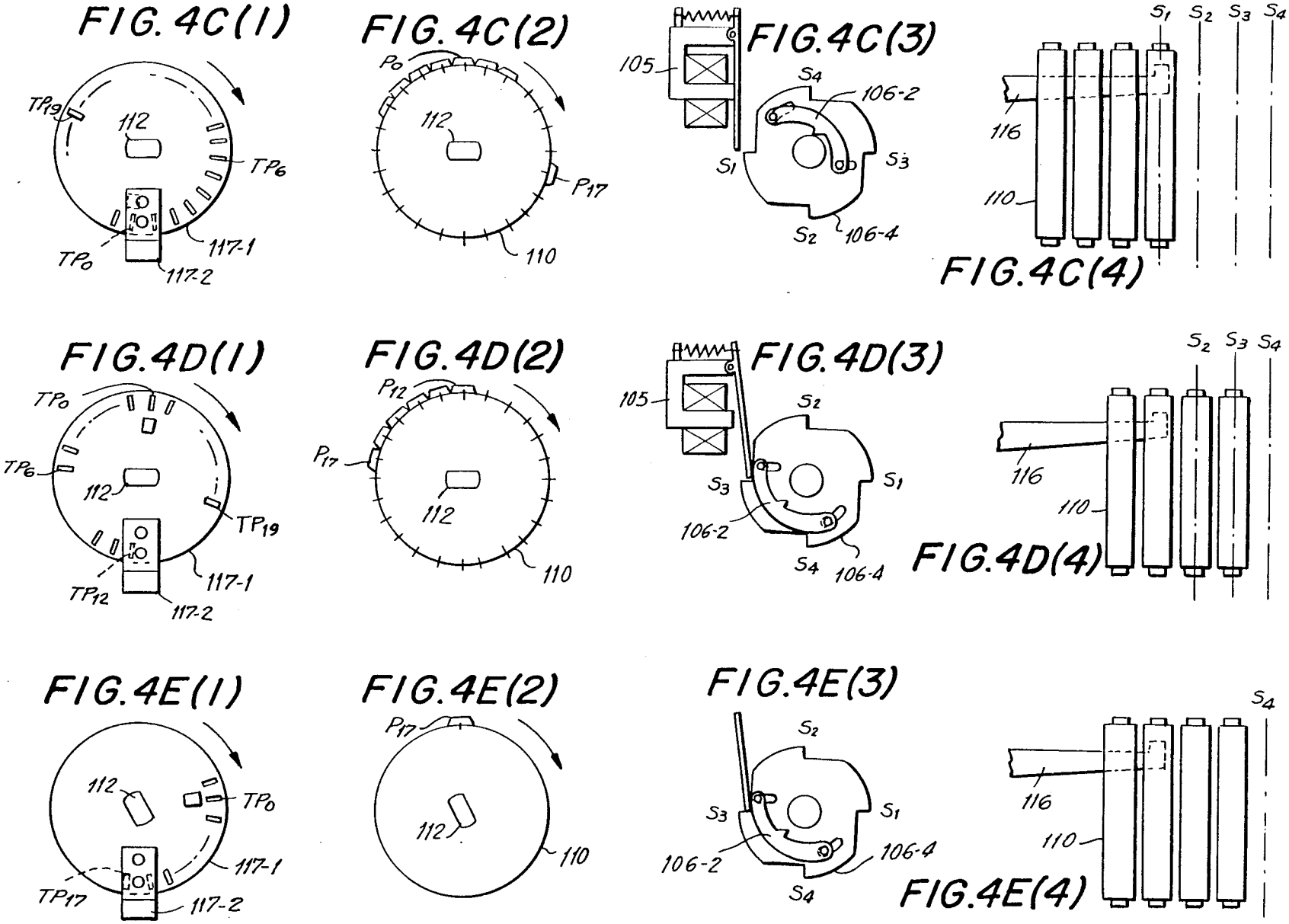
FIG. 4C(1)
FIG. 4C(2)
FIG. 4C(3)
FIG. 4C(4)
FIG. 4D(1)
FIG. 4D(2)
FIG. 4D(3)
FIG. 4D(4)
FIG. 4E(1)
FIG. 4E(2)
FIG. 4E(3)
FIG. 4E(4)
112
110
116
117-1
117-2
105
106-2
106-4
S1
S2
S3
S4
TP0
TP6
TP9
TP12
TP17
TP19
P0
P12
P17

SERIAL PRINTER HAVING TRIGGER MECHANISM

BACKGROUND OF THE INVENTION

The present invention relates to a printer and, more particularly, to a serial printer which is actuated by a trigger mechanism to print alphanumeric characters from type in a type wheel stack.

Known serial printers usually select characters for printing by shifting and turning a wheel or a type cylinder, on which the type is carried, about a vertical axis on a carriage. The carriage moves the width of a paper sheet which is to be typed upon. Since such a type cylinder has a substantial height and must be moved a substantial distance, the carriage on which it moves must be large in size. Contributing to the size of the mechanism are shift selection and type selection mechanisms of a complex nature, including electromagnets, clutches, cams, and levers, all of which are controlled by a complicated process. For these reasons, it has heretofore been difficult to produce a small-size, inexpensive serial printer.

The serial printer described in Japanese Patent Laid-Open Publication No. 57-109677 has gone part of the way towards solving the above problem. The mechanism for shifting a stack of type wheels which is shown there, however, is not simple, since it requires a cam shaft passing through the carriage for transmitting drive power to a shift cam on the carriage to shift the type cylinder, a second shaft for turning the type cylinder and a pair of detectors for detecting the shifted and the angular positions of the type wheel stack.

In the serial printer shown in Japanese Patent Laid-Open Publication No. 57-173188, a hammer and a stack of type wheels which face each other on either side of an interposed sheet of print paper are driven by independent step motors and effect shift selection in response to differences in intervals of feed of the hammer and of the type wheel stack as it is moved across printing positions. This serial printer is expensive, however, as it requires costly machine components, such as step motors, and a transmission mechanism which uses wires for shift selection. Furthermore, the control process for driving the two independent step motors is complex. This serial printer is not suitable for low current designs and, most particularly, cannot be battery-driven. Also, the step motors themselves are, as a general matter, not efficient sources of motive power.

SUMMARY OF THE INVENTION

According to the present invention, the aforesaid problems in the prior art are solved in a printer mechanism in which a type wheel shaft and a type wheel stack are arranged horizontally on a carriage which is movable along a line of character positions in front of a platen. A shift cam mechanism and a shift clutch are disposed on a common axis with the type wheel shaft, yielding a compact and easily assembled unit which can be made of inexpensive parts.

Further, the print hammer, its driving mechanism, and selector mechanisms for choosing a particular type from various types on the stack of type wheels are also supported on the movable carriage. The type selecting mechanisms include a mechanism for positioning a chosen one of the type wheel stack so that its types can be moved in front of the hammer, and a mechanism for stopping rotation of the type wheel stack when the type to be printed is in front of the hammer. The mechanisms on the carriage include a transmission for shifting the type wheels, a transmission for rotating the selected type wheel, and a transmission for driving the hammer. The action of each of the transmissions is controlled by a clutch which can be selected to effect delivery of power from the motor to its associated mechanism. Each clutch is selected by a trigger from an associated trigger mechanism. In the preferred embodiment, each trigger mechanism includes an electromagnet which responds to a control signal to actuate a lever; the lever, in turn, initiates the delivery of power to the desired transmission via the respective clutch. All of the mechanisms receive rotary power from a single power train which is driven by the motor and which includes a type wheel shaft and the type wheel stack.

In operation, power from the motor is delivered via the type select clutch to the type wheel shaft, causing the type wheel stack to rotate. Then the type wheel select clutch is engaged to shift the desired type wheel into position in front of the hammer. When this operation is complete, the type wheel select clutch is disengaged. The type select clutch remains engaged until the type wheel shaft has rotated the desired type on the selected type wheel into position in front of the hammer. Rotation of the type wheel shaft is then discontinued by disengaging the type select clutch and power from the motor is delivered to the hammer mechanism by engaging the print clutch. Upon completion of the printing stroke, the print clutch is disengaged and the type selection clutch is once more engaged to cause the type wheel shaft to rotate, ready for the next cycle.

Further, according to the invention, the drive motor, the mechanism for selecting a desired type from the types on a type wheel, the mechanism for shifting a chosen type wheel to position it in front of the hammer, the hammer and the hammer driving mechanism, and the mechanisms for switching power between the type selecting operations and the printing operation are all disposed on the movable carriage, either on a carriage plate or in a carriage housing, or both. In this way, almost all the necessary mechanisms for the printer are concentrated on the carriage and power is transmitted between the mechanisms without substantial loss, resulting in the need for only limited power to effect reliable transmission. Since almost all the mechanisms needed for the printer are concentrated in the carriage, they can be assembled into a unit which lends itself to efficient manufacture. Also, since most of the mechanisms, other than the type wheels, can be enclosed within the carriage housing, dust is kept out of the printer, eliminating a major source of trouble.

Drive power for shift selection of the type wheel stack is derived from the type wheel shaft which receives its power from a single small DC motor via a differential mechanism and a 1/N rotation clutch which responds to a control-signal-actuated trigger. Included in the shift selection mechanism are a pawl-and-ratchet clutch mechanism, a trigger electromagnet and actuator arm, a type wheel cam shift mechanism, and a shaft rotation detector which does double duty as a type position detector and a shift position detector, the type wheels being selected, shifted and printed from the same source of drive power. Selection of a type and printing of the selected type is alternately controlled by a single switching device.

The simplified printer of the invention is smaller in size, can be assembled with ease, and can be manufactured at a lower cost due to the reduced number of required parts. The drive source for shift selection, for character selection, and for printing comprises a common small-size DC motor, so that low current consumption is achieved. As a consequence, the printer of the invention is well suited for use where small size, inexpensiveness, an ability to be battery-driven, and the capability of printing alphanumeric characters are needed.

It is an object of the present invention to provide a serial printer which is small is size, low in cost, and capable of printing alphanumeric characters.

It is a further object of the invention to provide a serial printer which is inexpensive, small in size, has a low power requirement, is constructed of a reduced number of components, and has a high printing speed.

It is another object of the invention to provide a serial printer which can readily be assembled in an economical manner.

It is a still further object of the invention to provide a printer in which the main mechanism of the printer travels on the carriage and in which only those mechanisms directly involved in producing either movement of the carriage or in feeding paper across the platen are located on the chassis of the printer.

It is another object of the invention to provide a serial printer in which a substantial number of the active printer parts are combined into a subassembly.

It is a further object of the invention to provide a serial printer having rotating parts, such as gear trains, which are contained within an inexpensive cover for the purpose of safety and for keeping out dust.

It is another object of the invention to provide a serial printer having a printer mechanism which uses lower current and which can be battery-driven so that the printer may be portable.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such characteristics, all as exemplified in the following detailed disclosure, and the scope of the invention will be indicated in the claims.

BRIEF DESCRIPTION OF THE DRAWINGS

For a fuller understanding of the invention, reference is had to the following description, taken in connection with the accompanying drawings, in which:

FIGS. 4C–4E show the mechanical movements of various parts which correspond to the signals indicated in the timing chart shown in FIG. 4A;

DETAILED DESCRIPTION OF THE INVENTION

Figure 1:
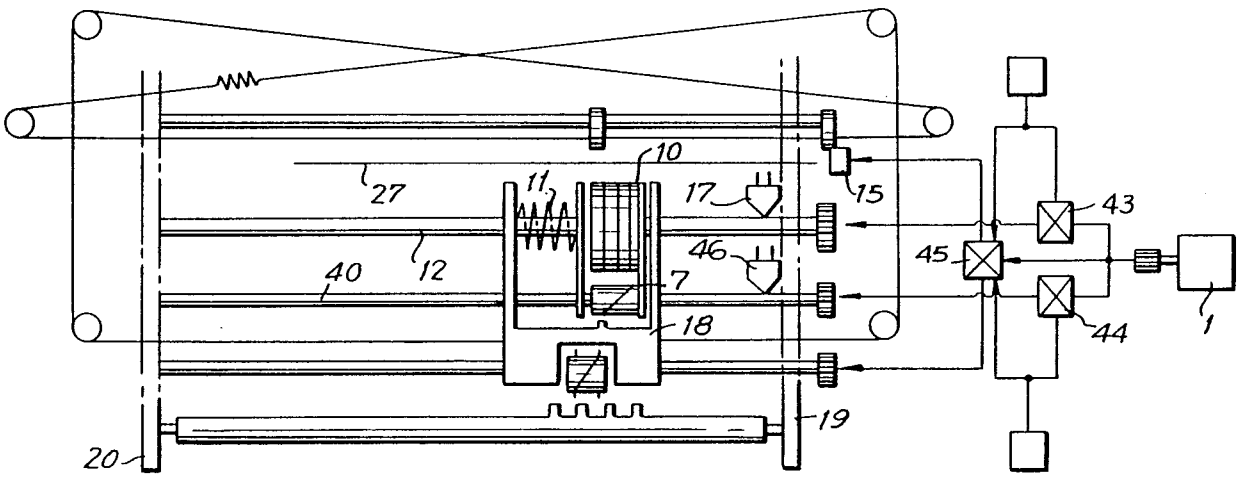
FIG. 1 PRIOR ART
FIG. 1 shows a conventional serial printer.

FIG. 1 is a schematic representation of a serial printer of the prior art, showing the manner of driving elements of the printer, such as the paper drive, the carriage shift, the printer mechanism, etc., from a single source of motive power. In it, drivr motor 1 is supported on the chassis (shown in part in phantom as 19, 20) of the printer and is coupled by clutches 43, 44, and 45 to a number of shafts 12, 40, etc., which communicate with parts on the carriage. A stack of print wheels 10 is rotatable on shaft 12 by power transmitted on shaft 40 from clutch 43. The positioning of stack 10 on shaft 12, relative to the point of printing, is accomplished by power derived from shaft 40 which is driven by clutch 44. The rotational position of stack 10 is detected by first detector 17. A second detector 46 detects the shifted position of stack 10 from the rotational position of shaft 40. In addition to positioning carriage 18 along the length of the paper 27, power from motor 1 is also used to advance the paper.

Figure 2:
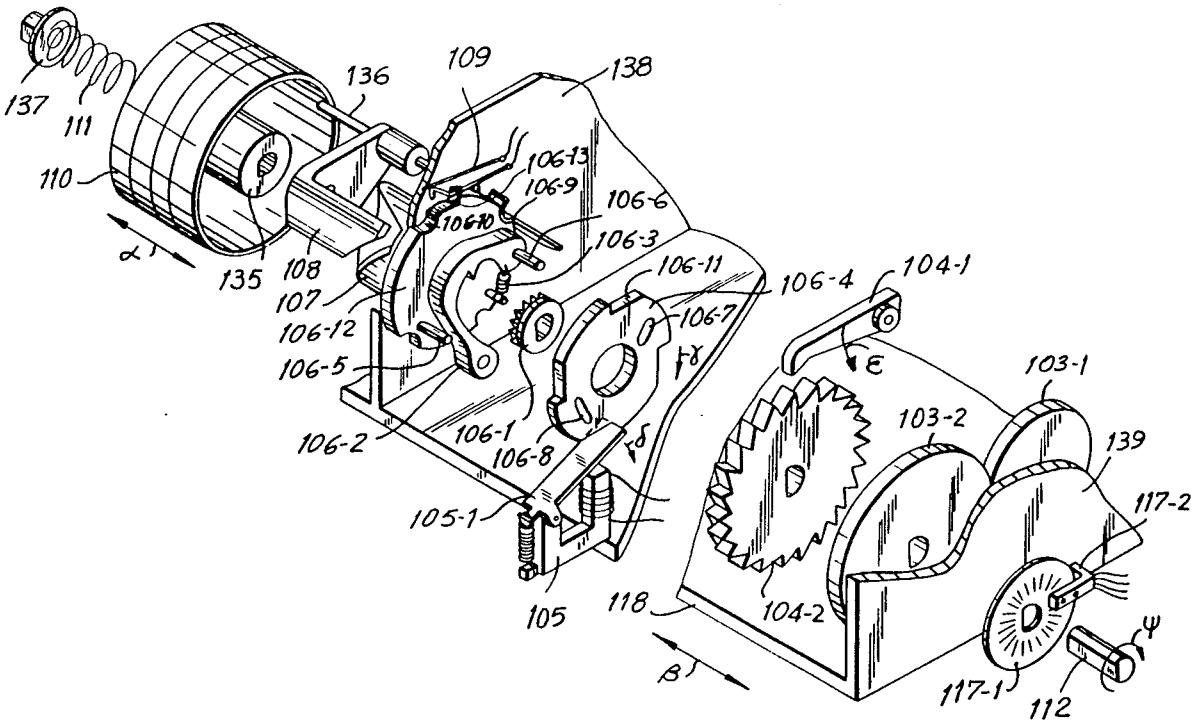
FIG. 2 is a perspective view primarily showing the shift selection mechanism of an embodiment of the invention.
Figure 3:
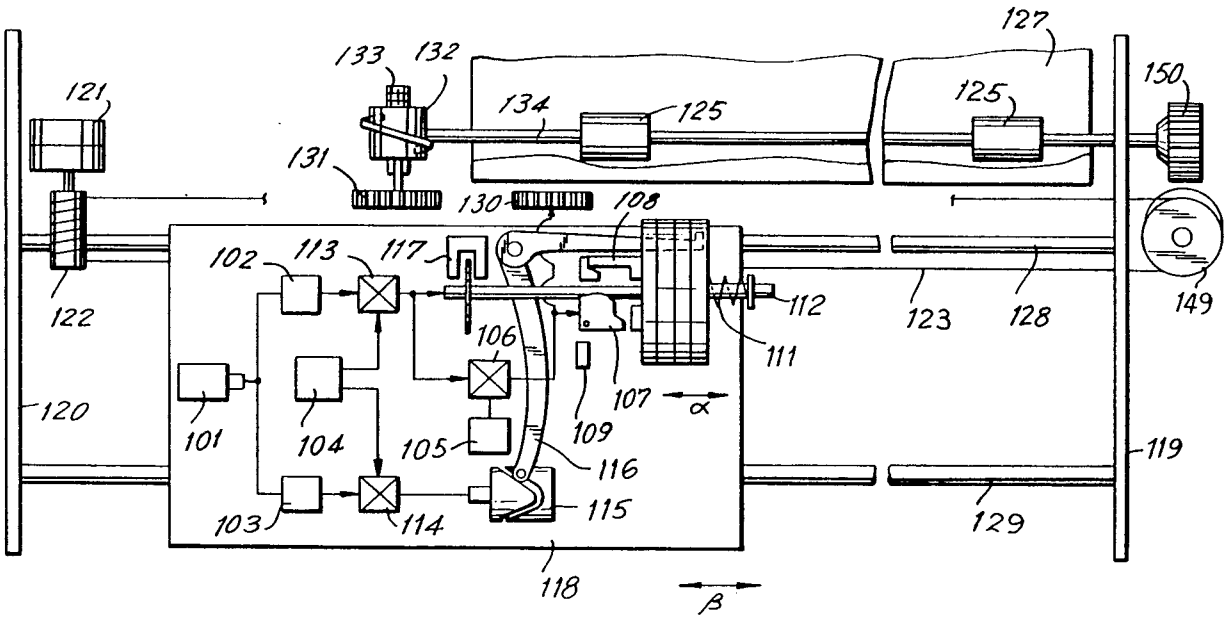
FIG. 3 is a block diagram of a printer employing the mechanism of FIG. 2.
Figure 5:
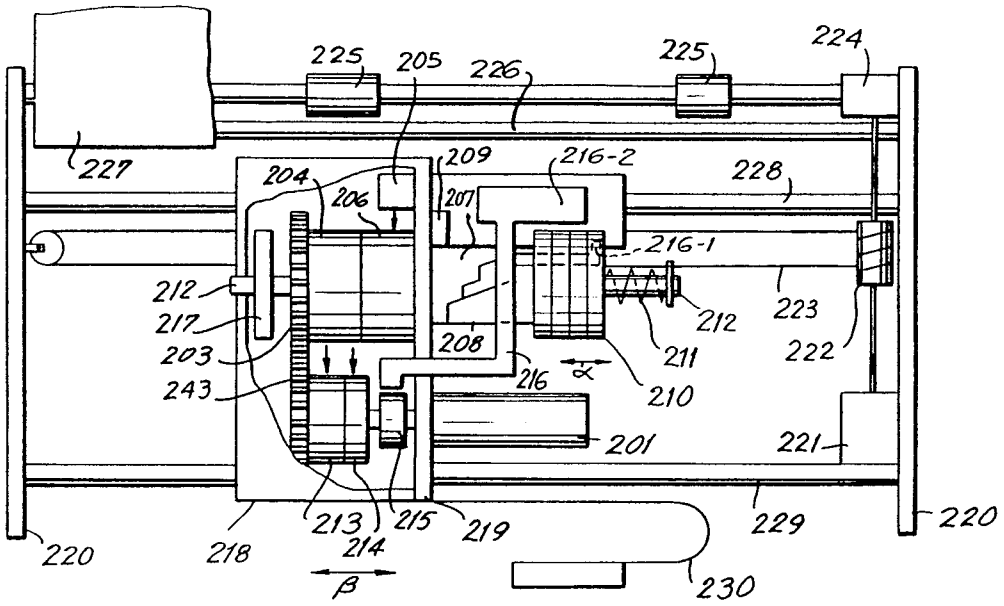
FIG. 5 is a plan view schematically showing elements of a second printer constructed in accordance with the present invention.
Figure 9:
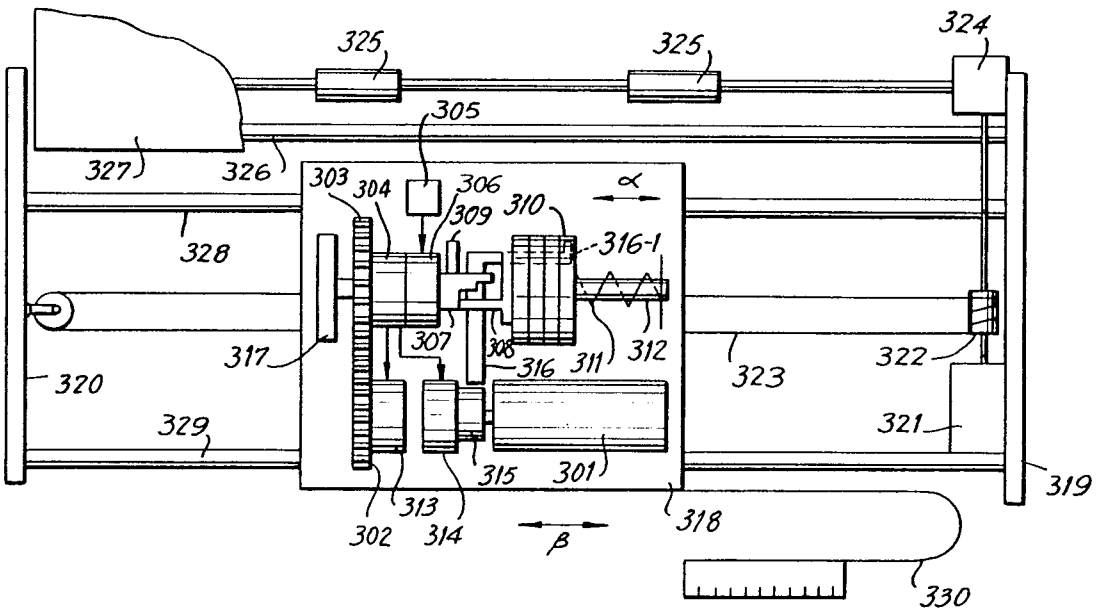
FIG. 9 is a top view showing, schematically, an arrangement of still another printer constructed in accordance with the teachings of the invention.

Various features of the present invention will now be illustrated using the three illustrative embodiments of FIG. 3, FIG. 5, and FIG. 9. As can be seen by comparing corresponding FIGS. 3, 5, and 9 as well as the detailed perspective views of FIGS. 2 and 6, similar elements of the printer mechanisms of these embodiments carry related numbers. Thus, the drive motor on the printer carriage is numbered 101, 201, or 301, depending upon whether it appears in the first, second, or third illustrative embodiment. Similarly, the type selection and print trigger is numbered 104, 204, or 304, the type wheel shift trigger is numbered 105, 205, or 305, the print wheel stack is numbered 110, 210, or 310, etc., according to the illustrative embodiment in which each of them appears.

FIG. 3 shows a schematic view of a serial printer fabricated in accordance with the invention; portions of this printer are more particularly shown in FIG. 2. Carriage 118 is mounted on slides 128, 129 of a printer chassis 119, 120 for lateral movement in the direction of the arrow $\beta$ along a line of character positions in front of paper 127 which is backed by a platen (not shown). Type wheel shaft 112 is supported on carriage 118 and extends laterally in the direction of arrow $\beta$, being rotatable about its own axis but being axially immovable, relative to carraige 118. A stack of type wheels 110 is splined to type wheel shaft 112 and is urged by shift return spring 111 toward shift cam 107. Boss 135 of stack 110 urges shift cam follower 108 into contact with shift cam 107. Removal of shift return spring 111 is prevented by detachable retainer 137 mounted on one end of type wheel shaft 112. Shift cam 107 is joined to shaft clutch plate 106–12, the assembly being held by side plate 138 of carriage 118 so as to be rotatable on, but not movable axially of, type wheel shaft 112. Shaft 112 passes through the center of shift cam 107. Shift cam follower 109 is prevented from turning by shift guide shaft 136, one end of which is fixed to carriage 118. Shift cam 107 has a slanted cam surface which is held in contact with shift cam follower 108 and which has as many stable points as there are type wheels (four in this embodiment).

Designated in FIG. 2 as 106-1 through 106-13 are components of shift clutch 106 by means of which power for selecting the axial position of the type wheel is switched. Shift ratchet 106-1 is splined to type wheel shaft 112, being secured in position, for example, by being present on or by being held with a retaining ring. Shift pawl shaft 106-5 is mounted on shift clutch plate 106-12 and is thereby fixedly connected to shift cam 107. Shift pawl shaft 106-5 faces away from the cam surface on shift cam 107. Carriage side plate 138 is interposed between shift cam 107 and shift pawl shaft 106-5. Shift pawl 106-2 is angularly movable, having one end turning about shift pawl shaft 106-5. A pin 106-6 is secured to the free, distal end of shift pawl 106-2 and engages in oblong hole 106-7 in clutch disk 106-4. The relative angular position of shift pawl 106-2 is determined by the shape of oblong hole 106-7 and the relative angular position of clutch disk 106-4. CLutch disk 106-4 is limited in its angular movement by shift pawl shaft 106-5 which engages in oblong hole 106-8 in the clutch disk. Oblong hole 106-8 is so shaped that, when clutch disk 106-4 is stopped after having turned in the direction of arrow $\gamma$, shift control pawl 106-2 is lifted out of engagement with shift ratchet 106-1. Under normal conditions (as shown in FIG. 2), shift pawl 106-2 is pulled by shift control pawl spring 106-3, resulting in the urging of the clutch disk 106-4 in the direction of the arrow $\gamma$ because of the engagement between shift control pawl pin 106-6 and oblong hole 106-7. Hence one of recesses 106-11 in the outer periphery of clutch disk 106-4 is engaged by movable arm 105-1 of type wheel shift trigger electromagnet 105 and shift control pawl 106-2 is lifted out of engagement with shift ratchet 106-1. The number of recesses 106-11 in the periphery of clutch disk 106-4 is equal to the number of type wheels. The distal end of detent spring 106-9 rests in one of recesses 106-10 in the periphery of shift clutch plate 106-12 when the clutch is not in operation (as shown in FIG. 2) to make the phase of the shift cam accurate and to stabilize the position of shift control pawl shaft 106-5. One recess 106-10 is provided for each type wheel. Shift reset detector switch 109 serves to locate a reference position of the shift cam and, thus provides an axial reference position of the type wheel stack. Specifically, the switch is closed at a predetermined position of shift clutch plate 106-12 by a projection 106-13 in the periphery thereof.

There are also mounted on type wheel shaft 112, portions of a type selection mechanism for controlling the rotation of the type wheels, and a type position detector. The first of these includes selection drive gear 103-2 and type selection ratchet wheel 104-2 both of which rotate in unison with type wheel shaft 112 and are drivable by selection drive gear 103-1. Type selection ratchet 104-2 has as many teeth as there are type positions on the type wheels. When selection/print trigger electromagnet 104 (See FIG. 3) is energized, a type selection trigger lever (not illustrated) is turned so that type selection pawl 104-1 which is engaged with the type selection trigger lever is turned in the direction of the arrow $\epsilon$. When type selection pawl 104-1 is turned in the direction of arrow $\epsilon$, it engages type selection ratchet 104-2 for type selection. Type position detector 117 includes detector plate 117-1 which rotates in unison with type wheel shaft 112, and photointerrupter 117-2. Type position detector 117 serves as a means for detecting an extent of angular movement of type wheel shaft 112 to generate a type position detection signal which corresponds to each type position and a type position reference signal which is generated only once during one revolution of type wheel shaft 112.

Operation of the above mechanism is as follows. Since power for shift selection of a type wheel is derived from rotation of type wheel shaft 112, the operation of shifting to select a type wheel must be completed before a type can be selected. A specific example will be described with reference to the timing chart of FIG. 4. In the illustrated embodiment, there are four type wheels in the type wheel stack 110 and each type wheel bears a total of 24 types, for a total of 96 types in the type wheel stack. Shift cam 107 therefore has a cam curve which produces three positive strokes for positioning type wheel stack 110 at any of four locations during one revolution of shift cam 107. Clutch disk 106-4 is normally urged in the direction of the arrow $\gamma$ by spring 106-3 and is prevented from rotating by the movable arm of shift trigger electromagnet 105 except when the latter is energized. When type wheel shift trigger electromagnet 105 is energized after type wheel shaft 112 has started to turn, movable arm 105-1 (FIG. 2) is attracted in the direction of arrow $\delta$, permitting clutch disk 106-4 to turn through a predetermined angle in the direction of arrow $\gamma$. Shift pawl 106-2 moves in, engaging shift ratchet 106-1, and causing shift cam 107 to start turning with type wheel shaft 112. The cam curve of shift cam 107 has four stable points, $S_1$, $S_2$, $S_3$, $S_4$, and type wheel shaft 112 moves angularly a quarter turn to move the type wheel stack between two adjacent stable points. During this time, $\frac{1}{4}\times 24=6$ pulses of a type position detection signal from type position detector 117 are detected. When the type wheel stack is to be shifted j steps ($j\leqq 3$), $6\times j$ pulses of the position detection signal are detected. The shift trigger electromagnet 105 is energized each time that 6 pulses of the type position detection signal are generated. This energization occurs for only one pulse since the response of the clutch movement is so fast that clutch disk 106-4 begins to turn and shift pawl 106-2 is brought into engagement with shift ratchet 106-1 during one pulse energization of shift trigger electromagnet 105.

Figure 4A:
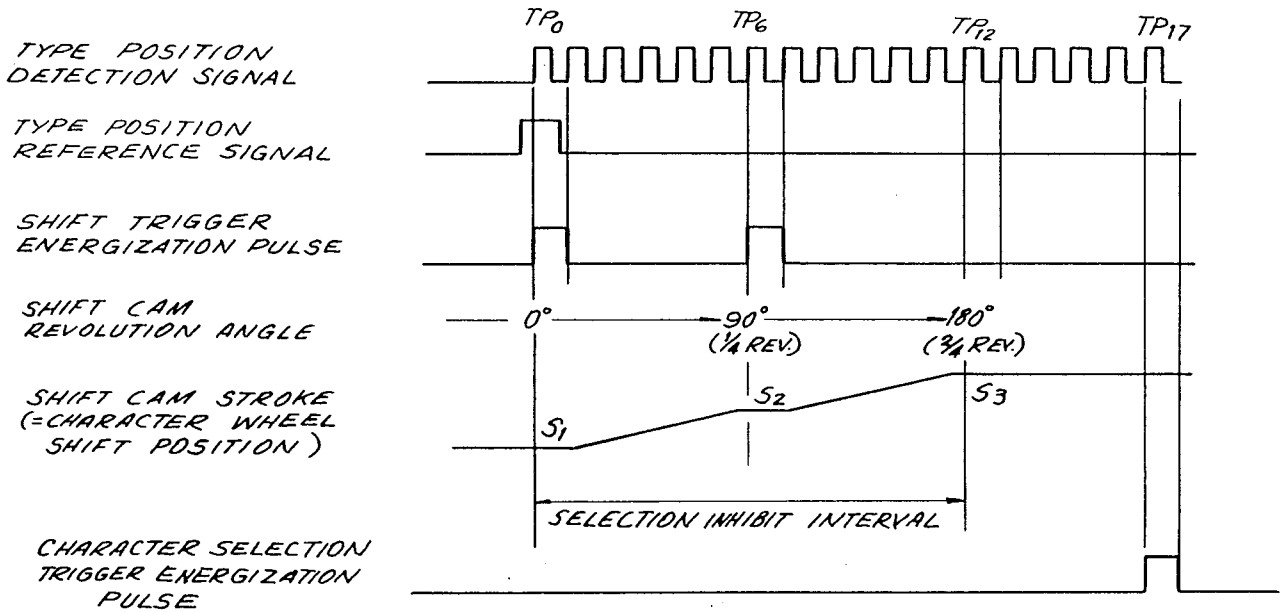
FIG. 4A is a timing chart illustrating a character selection stroke including shift selection.
Figure 4B:
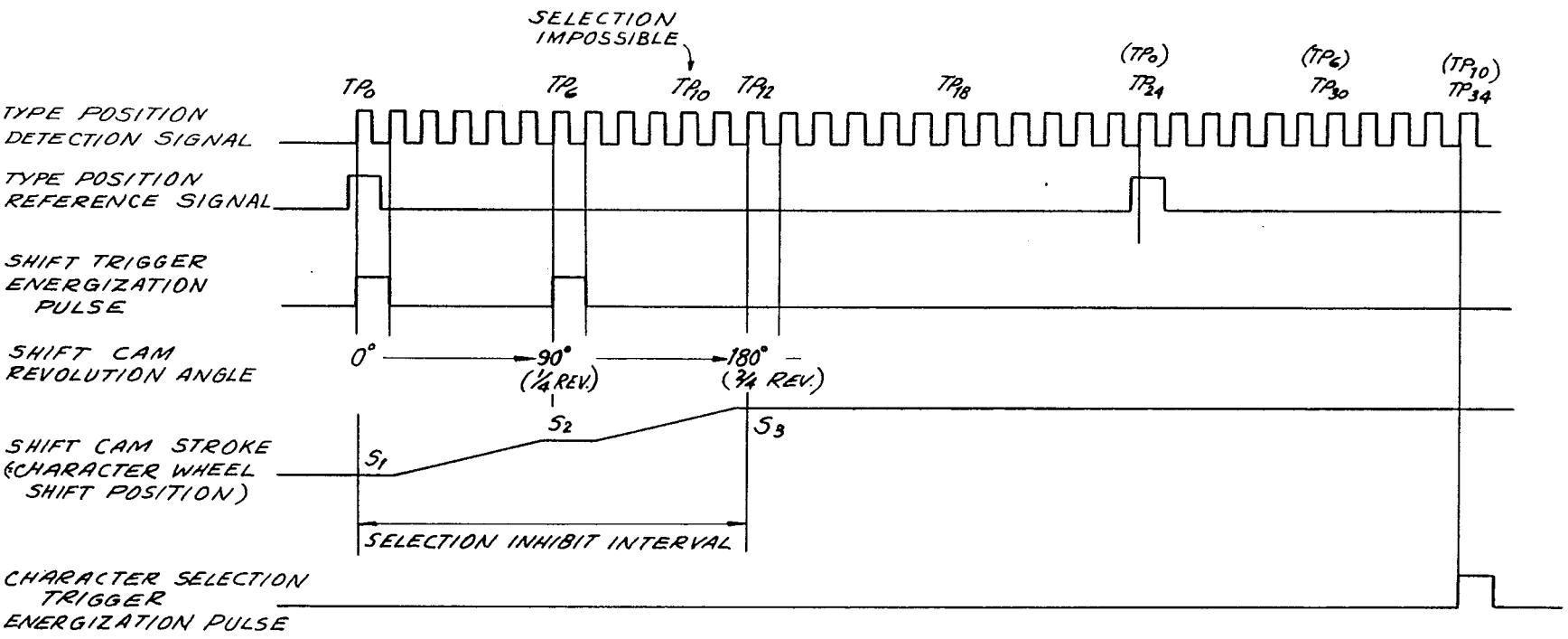
FIG. 4B is a timing chart illustrating another character selection stroke including shift selection.

Since no type can be selected while shift clutch 106 is in operation, type selection is inhibited during $6\times j$ pulses after shift clutch 106 has been actuated. FIG. 4A shows a stroke starting with a type position detection signal $TP_0$ in a type wheel corresponding to $S_1$ until a type is selected which corresponds to $TP_{17}$ in a type wheel corresponding to $S_3$. The type position signal $TP_0$ is a signal generated first after the generation of the type position reference signal. $TP_{17}$ is the 17th pulse after $TP_0$. When selecting a type corresponding to $TP_{10}$ in $S_3$, for example, type wheel shaft 112 should be turned for one more revolution to select $TP_{34}$ (See FIG. 4B).

FIGS. 4C–4E show the mechanical movements of the parts 105-1, 106-4, 110 and 117-1 which correspond to the signals indicated on the timing chart shown in FIG. 4A.

Photointerrupter 117-2 generates type position detection signals 24 times and a type position reference signal once during one rotation of type wheel shaft 112. Detector plate 117-1 has 24 slits along its periphery and one slit inside the above slits. Each time that respective slits pass the optical axis, the output level of photointerrupter 117-2 is changed to thereby produce type position detection signals and the type position reference signal.

As shown in FIGS. 4C–4E, upon generation of a type position detection signal $TP_0$ corresponding to a type $P_0$ on the type wheel corresponding to $S_1$, shift trigger electromagnet 105 is energized to attract moveable arm 105-1, whereby shift clutch disk 106-4 is rotated for transmitting power. Thus, the type wheel stack 110 starts to be shifted. This state is shown in FIG. 4C.

Type wheel shaft 112 is then rotated through 90° and at this time shift trigger electromagnet 105 is energized again. Type wheel shaft 112 is then rotated through 180°, namely to the type position $P_{12}$ corresponding to detection signal $TP_{12}$, and the type wheel stack 110 is shifted to the position corresponding to $S_3$. This state is shown in FIG. 4D. Without energization of shift trigger electromagnet 105 at this time, the type wheel stack 110 is held in the position corresponding to $S_3$.

Type wheel shaft 112 is then further rotated until it reaches the type position corresponding to $TP_{17}$. This stage is shown in FIG. 4E. When selection/print trigger electromagnet 104 is energized in this state, the type selection is effected. Printing is thus possible of a type corresponding to $TP_{17}$ on the type wheel corresponding to $S_3$.

FIG. 3 shows an embodiment of a serial printer using the type wheel selection mechanism of the present invention. Drive power from motor 101, mounted on carriage 118, is applied through speed reducer 102, via type selection clutch 113, to type wheel shaft 112 and to shift clutch 106, and is also applied through speed reducer 103 to print clutch 114. After energizing shift clutch 106 to select a type wheel, type selection and print trigger electromagnet 104 is energized to actuate the type select and print clutches. Actuation of type selection clutch 113 stops type wheel shaft 112 from rotating, effecting type selection. De-energizing electromagnet 104 causes a one-cycle printing stroke to be started during which print hammer 116, driven via cam 115 from print clutch 114, strikes the selected type after shaft 112 has stopped at the desired location. Type wheel shaft 112 begins to turn again after type selection and print trigger electromagnet 104 is deenergized and continues to turn until electromagnet 104 is again energized. While shaft 112 is turning, character wheel shift trigger electromagnet 105 can again be energized to actuate shift clutch 106, shifting the type wheel stack in the process described above for the next wheel selection.

In the printer embodiment illustrated in FIG. 3, rotary power from shift cam 107 is also provided to paper feed drive gear 130. When step motor 121 is reversed to return carriage 118 to a standby position after the printing of a line, paper feed drive gear 130 and paper feed transmission gear 131 are brought into mesh with each other, allowing the rotary power from the shift cam 107 to drive paper feed shaft 134 via gear train 130, 131, 132, and 133. Therefore, by turning the shift cam through a predetermined interval while the carriage is in the standby position, power from the printer mechanism motor on the carriage can be taken off and used to feed paper in various selected line-to-line pitches or at a fast rate. Paper feed is effected by the engagement of rollers 125, mounted on feed shaft 134, against paper 127, on a platen (not shown). Shaft 134 can be manually rotated by knob 150. Carriage 118 is displaced by wire 123 which extends about drum 122 and pully 149 and is secured to carriage. Step motor 121 is coupled to drum 122 to drive same.

Figure 6:
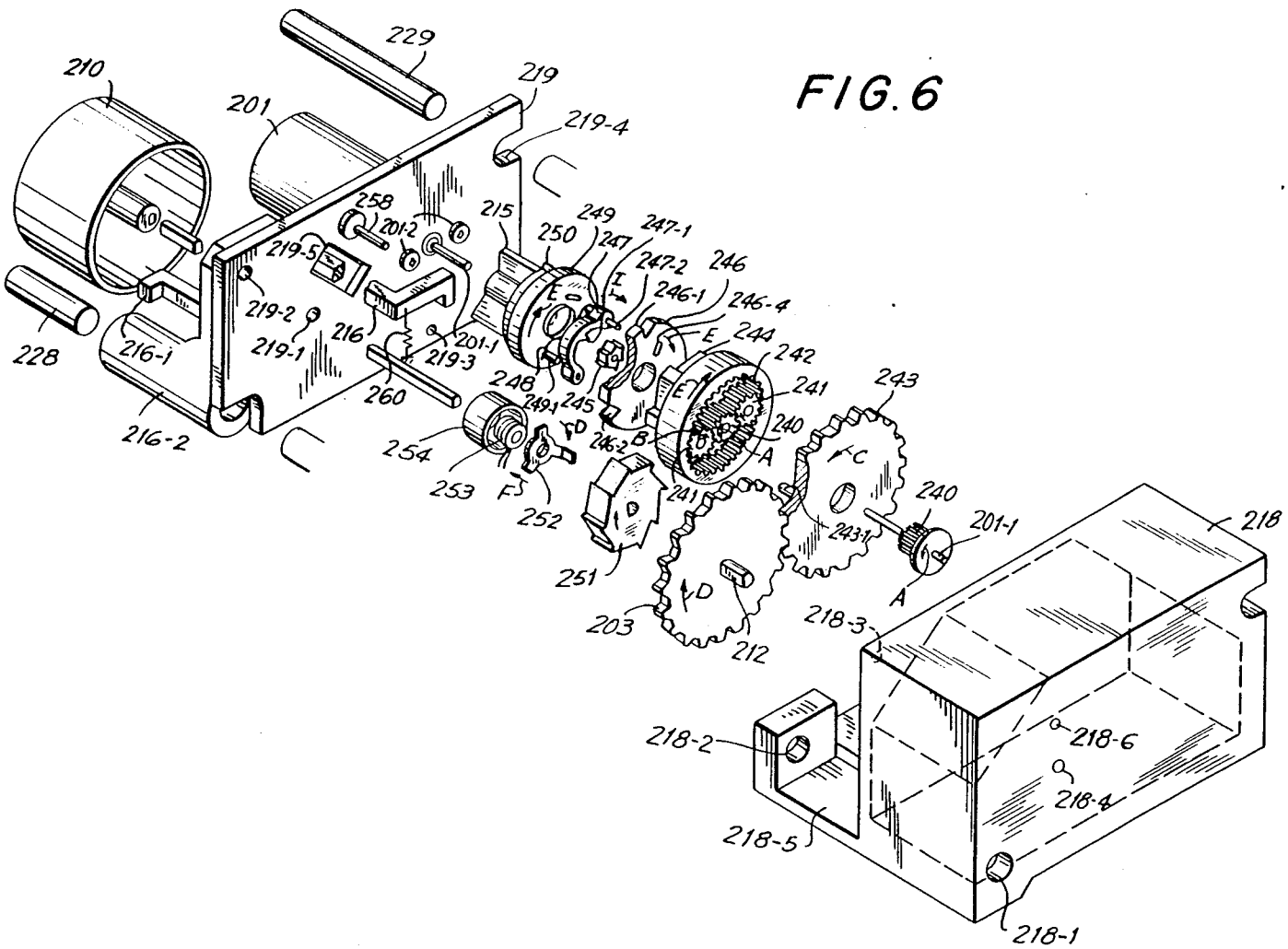
FIGS. 6 and 7 are perspective views of portions of the printer mechanism used in the printer of FIG. 5.

Referring now to FIGS. 5 and 6, a second embodiment of the invention is shown. FIG. 5 schematically depicts the printer mechanism while FIG. 6 is an exploded view of a portion of the type selecting mechanism, the hammer, and the associated drive of this embodiment. The printer of FIGS. 5 and 6 is characterised by its use of a carriage plate to carry the mechanism responsible for printing. In the printing mechanism, electric drive motor 201 is secured to metal carriage plate 219 by means of screws 201-2 (FIG. 6). Motor 201 has a shaft 201-1 to which a gear train and a cam are connected. Type wheel shaft 212 is supported, in part, by insertion into hole 219-1 in carriage plate 219 while the printer is being assembled. After the printer has been assembled, as described later, shaft 212 further passes into a hole 218-4 formed in carriage housing 218, and is then firmly supported. A support shaft 258 for certain levers, to be described in detail below, is secured to carriage plate 219 by crimping. Carriage plate 219 is further provided with cut-out 219-4 and with tapped holes 219-2 and 219-3. A guide shaft 229 (see also FIG. 5) is inserted in groove 219-4 so as to fit tightly in the vertical direction and loosely in the lateral direction.

Carriage housing 218 is entirely molded from a plastic, to define a space open on one side, indicated by the dashed lines in FIG. 6, which can receive the various gear trains and levers of the printer mechanism. Carriage housing 218 has holes 218-1 and 218-2 which receive guide shaft 228, a recess 218-5 in which boss 216-2 of hammer 216 is received, and tapped holes 218-3 and 218-4. Motor 201, the gear train which is associated with motor 201, type wheel shaft 212, the gear train which is associated with type wheel shaft 212, hammer 216, character position shift trigger 205, and shift position detector 209 are all secured to vertical carriage plate 219 and form a subassembly. Components 201-217 are all carried in carriage housing 218. Character position shift trigger 205 and shift position detector 209 are shown as blocks in FIG. 5 and are constructed in a manner similar to type position shift trigger 105 and shift position detector 109 of FIG. 2.

After completing the subassembly, tapped holes 218-3 and 218-6 in carriage housing 218 are aligned with tapped holes 219-2 and 219-3, respectively, of carriage plate 219. The carriage plate and housing are joined together using screws. In this way, the gear trains and other components are covered by carriage housing 218. Carriage plate 219 is also provided with an opening 219-5 through which hammer 216 passes.

The second embodiment of FIGS. 5 and 6 is operated as follows. Motor 201 drives type wheel shaft 212 via reduction gears 243 and 203 (FIG. 5). Gear 203 is a selector gear. Type wheel stack 210 rotates in only one direction together with type wheel shaft 212, but the wheels are free to move axially on the shaft as indicated by the arrow $\alpha$. Type wheels 210 are continuously biased axially on the shaft by spring 211 and are normally in rotation. Type selection and print trigger 204 has a trigger magnet which, when energized, acts to stop rotation of the type wheels. At that time, the power that was being delivered to type wheel shaft 212 by motor 201 is directed to printing selector clutch 213, which is normally at rest, and the printing selector clutch begins to turn. Then, when the electric current flowing through the magnet is cut off, printing selector clutch 213 provides power, via print drive clutch 214, which is also normally at rest, to drive printing cam 215 in rotation. This causes hammer 216 to push one type out of type wheels 210 from the inner side, the type element being inked by means of an ink roll (not shown). The result is that a character is printed on printing paper 227 which is backed by platen 226.

Type wheel shift trigger magnet 205 for type wheels 210 (FIG. 5) actuates clutch 206, switching type wheel shift cam 207 which is usually at rest and not in contact with shaft 212, into connection with type wheel shaft 212. This causes type wheel shift cam 207 to turn and moves cam follower 208 in the direction indicated by arrow $\alpha$. Cam follower 208 is not allowed to rotate. Since cam follower 208 is in contact with type wheels 210, it moves them against the bias of spring 211 in the direction indicated by arrow $\alpha$. In this way, the shift cam aligns a desired type wheel with forward end 216-1 of hammer 216. Shift position detector 209 detects the angular position of shift cam 207, and, hence, provides information locating the axial position of type wheels 210. Type position detector 217 indicates the angular position of type wheels 210. The shift trigger and selector mechanisms are not shown in FIG. 6 to permit showing certain portions of the apparatus. However, the structure is the same as that described above in connection with FIGS. 2 and 3.

Characters may be printed along the lateral width of paper 227 by moving carriage 218 in steps in the direction indicated by arrow $\beta$. To this end, forward or reverse rotation of stepper motor 221 is transmitted to wire 223, which is wound on drum 222 and is connected to the carriage defined by carriage housing 218 and carriage plate 219, whereby the carriage is moved. Rotation of motor 221 is transmitted to paper feed rollers 225 via paper feed selector mechanism 224, rotating the rollers in stepwise fashion, for feed of paper 227. The printer has a frame 220 and a flexible printed cable 230 which supplies electric power and electric signals to and from the various electrical components on carriage housing 218.

The structure and operation of portions of the speed-reducing mechanism and of the shift trigger mechanism are described next with reference to FIGS. 6 and 7. FIG. 6 shows the structure of principal portions of the mechanisms, with the shift trigger levers omitted. In the partially exploded view of FIG. 7, some of the components which were shown exploded in FIG. 6 are shown in assembled condition, along with the shift trigger levers which are omitted from FIG. 6. The shift trigger levers are shown in a position, relative to the assembled selector clutch and print clutch, which permits the showing of details to indicate the interaction of the parts. Both trigger levers, e.g. selector pawl 255 and print clutch actuation lever 256 (FIG. 7), are supported on pin 258 which, in FIG. 6, projects from vertical plate 219, parallel to motor shaft 201-1 and wheel stack shaft 212.

When motor shaft 201-1 is rotated, toothed wheel 240, securely fixed to the outer end of the shaft, is turned in the direction of arrow A. Toothed wheel 240 is the sun gear of a planetary gear train which constitutes a differential mechanism. The planetary gear train also includes planet gears 241, each mounted on a shaft 243-1 which is fixed to selector driving gear 243, and an internal gear 242. Sun gear 240 is shown both in place in the planetary assembly as well as exploded out to the right in FIG. 6. Power from toothed wheel 240 is thus fed to selector driving gear 243 and, through it, drives selector gear 203. At the same time, internal gear 242 drives printing cam 215 and a one-third revolution clutch composed of parts 245-250 (described below).

Selector pawl 255 (FIG. 7) has a pawl tooth 255-1 which prevents clutch ratchet 244 from rotating, clutch ratchet 244 being one of two ratchets which are formed integrally with internal gear 242. In this condition, power is not coupled to the shift mechanism, but planet gears 241 turn in the direction indicated by arrow B, and their movement is communicated via selector gear 203 to type wheel shaft 212. This rotates type wheel stack 210 in the direction indicated by arrow D. Selector pawl 255 has another tooth 255-2 (not visible in FIG. 7 but visible in FIGS. 8A–8E) which limits rotation of ratchet 251; ratchet gear 251 is formed integrally with selector driving gear 203 and, therefore, can stop rotation of type wheel shaft 212. When clutch ratchet 244 is freed from tooth 255-1, the rotation of gear 240 drives internal gear 242 in the direction indicated by arrow E for use in the printing stroke.

In accordance with the invention, a trigger mechanism includes trigger plate 252, trigger magnet coil 253, and trigger yoke 254 (FIG. 6). When trigger magnet coil 253 is energized, trigger plate 252 is attracted, in the direction indicated by the arrow F, to yoke 254, which is rotating with type wheel shaft 212. The rotation of yoke 254 then rotates trigger plate 252, (see FIG. 7) in the direction of arrow D, moving both selector pawl 255 and printing clutch actuation lever 256 in the direction indicated by arrow G.

Figure 7:
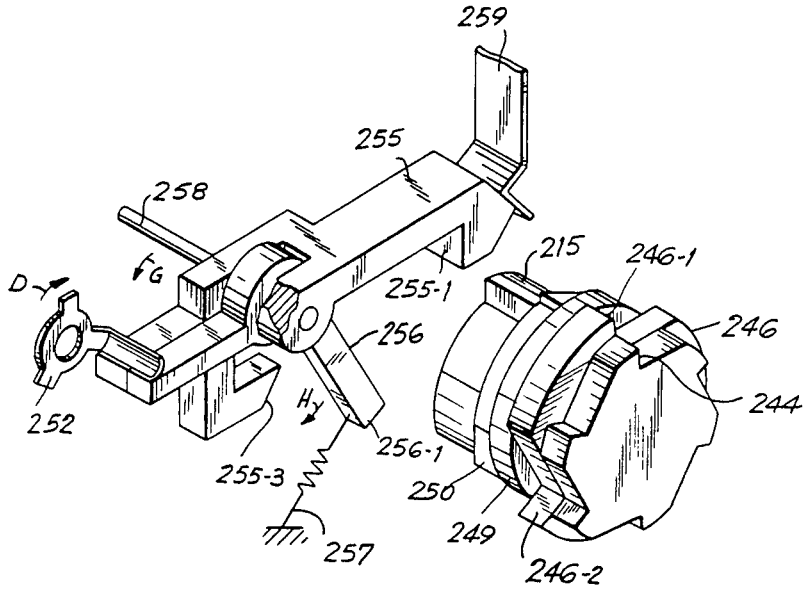

Pawl tooth 255-1 FIG. 7 is positioned to engage clutch ratchet 244 and one ratchet tooth 246-1 (of three ratchet teeth) on control disk 246 of the one-third revolution clutch. Distal end 256-1 of actuation lever 256 is positioned to engage second ratchet tooth 246-2 of control disk 246. Another pawl tooth 255-3 of selector pawl 255 is positioned to engage return cam 250. Return cam 250 is joined to main clutch portion 249 of the one-third revolution clutch. Bistable spring 259 makes the operation of selector pawl 255 positive.

In FIG. 6, many of the parts are shown in exploded form. These include motor shaft 201-1, motor gear 240, and type wheel shaft 212. Those parts which are integrally formed and are thus coupled together include: selector drive gear 243 and shafts 243-1 of planet gears 241; internal gear 242 and clutch ratchets 244 and 245 of the one-third revolution clutch; main clutch portion 249 of the one-third revolution clutch, return cam 250, and print cam 215; and selector gear 203 and ratchet 251.

Figures 8A, 8B:
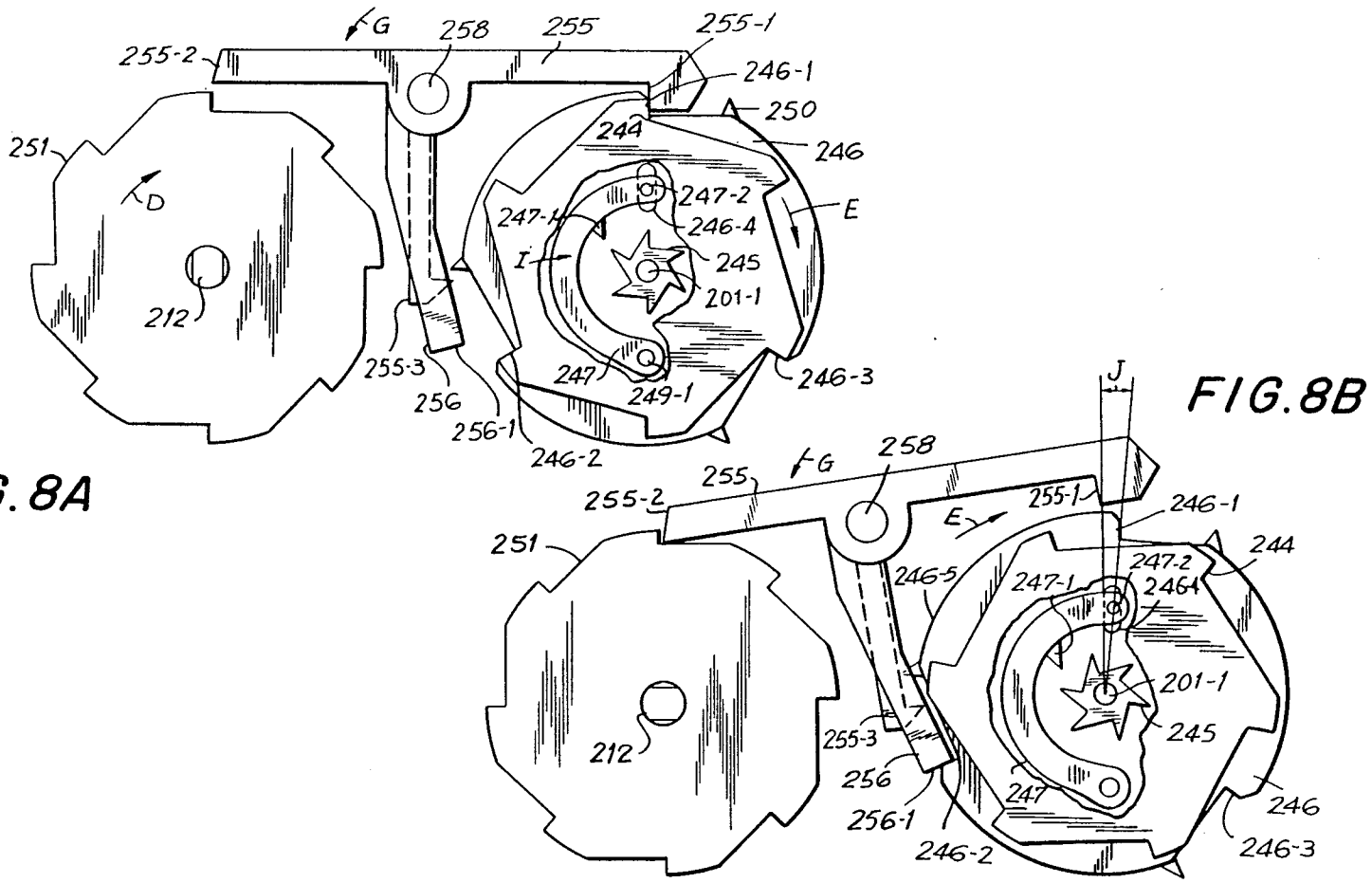
FIGS. 8A–8E are side elevational views illustrating the latching operation of certain levers used in controlling the printer mechanism of FIG. 5.

The construction and operation of the above-described portions of the printer is now described with reference to FIGS. 8A–8E. FIG. 8A shows the condition in which selector ratchet 251 is rotating, i.e., drive power from motor 201 is being transmitted to selector gear 203 and the mechanism is ready for the type selecting operation. Clutch ratchet 244 and ratchet tooth 246-1 of control disk 246 are retained by pawl tooth 255-1 of selector pawl 255, while pawl tooth 255-2 is out of contact with selector ratchet 251. Main clutch portion 249 has projecting pin shaft 249-1 on which clutch claw 247 is pivoted (shown in dotted lines in FIGS. 8A–8E). Claw 247 is biased by clutch spring 248 in the direction indicated by arrow I (FIGS. 6 and 8A). Pawl pin 247-2 fits loosely in hole 246-4 of control disk 246 to convey torque from the control disk to main clutch portion 249 in the direction indicated by arrow I.

FIG. 8B shows the condition in which the rotation of trigger plate 252 in the direction of arrow D (FIG. 7) has turned selector pawl 255 and actuation lever 256 in the direction indicated by arrow G. Selector ratchet 251 is retained by pawl tooth 255-2. Clutch ratchet 244 and control disk 246 have been disengaged from pawl tooth 255-1 so that the power of motor 201 and the force exerted by clutch spring 248 start rotation of clutch ratchet 244 and control disk 246, respectively, in the direction indicated by arrow E. Clutch ratchet 244 now rotates continuously but control disk 246 can rotate only through the angle J after tooth 246-1 is disengaged from pawl tooth 255-1, because distal end 256-1 of actuation lever 256 engages second ratchet tooth 246-2, temporarily halting the rotation. While control disk 246 is moving through angle J, printing cam 215 and printing hammer 216 (FIG. 6) hold main clutch portion 249 in place and prevent it from rotating. Since the outer periphery 246-5 of control disk 246 lies somewhat further from the axis than does the outer periphery of clutch ratchet 244, pawl tooth 255-1 does not prevent rotation of the clutch ratchet 244. The rotary movement of control disk 246 through angle J is insufficient to bring tooth 247-1 of clutch pawl 247 into contact with clutch ratchet 245. As long as trigger coil 253 (FIG. 6) remains energized, this condition is maintained.

Figure 8C:
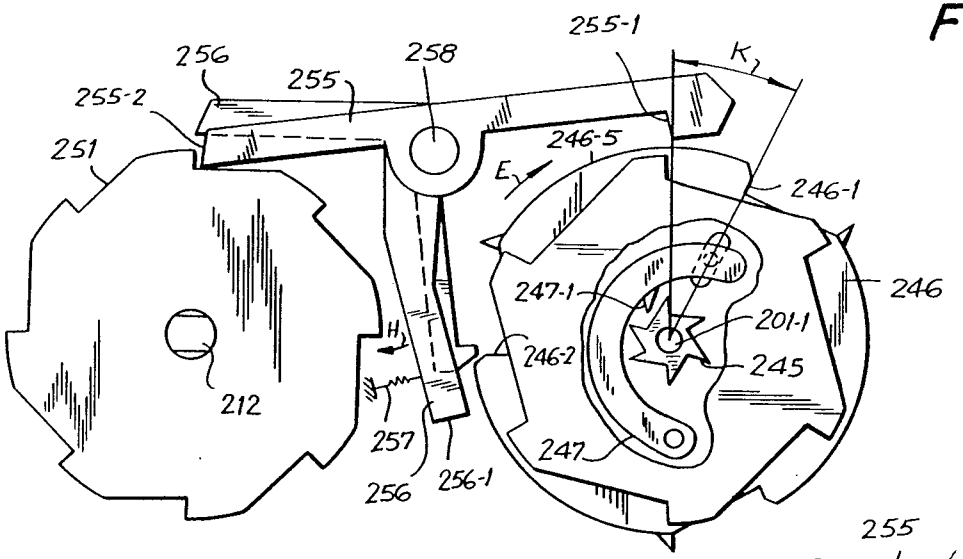

As shown in FIG. 8C, the de-energization of coil 253 permits spring 257 to return printing clutch actuating lever 256 in the direction indicated by arrow H. At this time, outer periphery 246-5 of control disk 246 prevents selector pawl 255 from moving in the direction indicated by arrow H. When distal end 256-1 of lever 256 disengages from ratchet tooth 246-2, the action of clutch spring 248 (FIG. 6) causes control disk 246 to rotate through angle K in the direction indicated by arrow E. At the same time, clutch claw 247 also rotates so that its tooth 247-1 is placed in the path of clutch ratchet 245. Rotation of clutch ratchet 245 then causes clutch pawl 247 to turn main clutch portion 249 (FIG. 6) in the direction indicated by arrow E and print cam 215 is rotated to drive hammer 216. The rotation continues until the printing operation is finished.

Figure 8D:
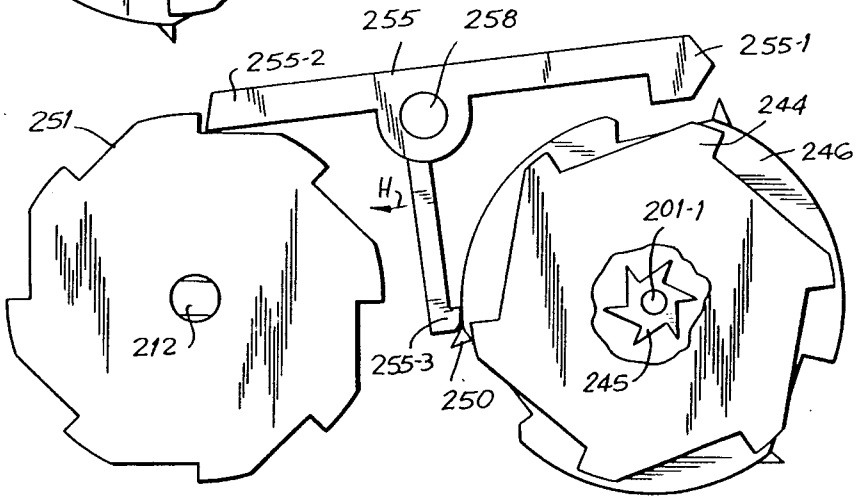
Figure 8E:
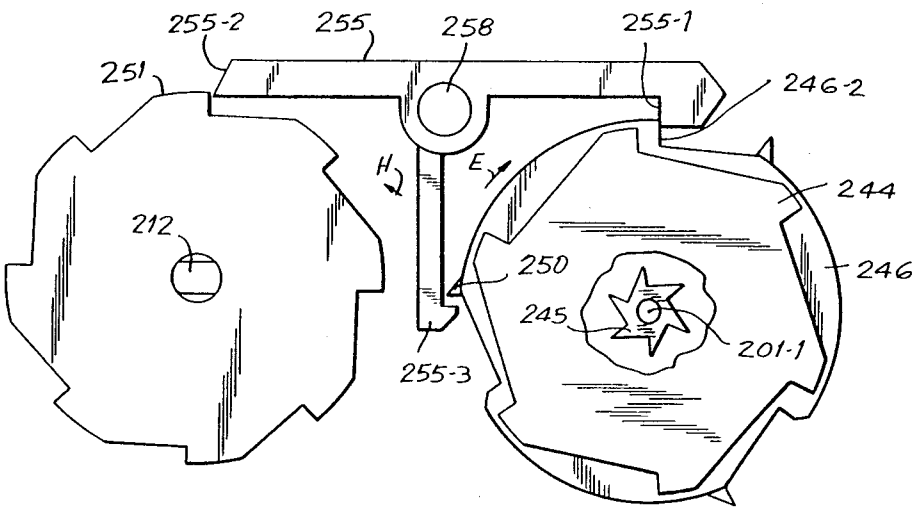

Then, as shown in FIG. 8D, further rotation brings return cam 250 into contact with tooth 255-3 of selector pawl 255 to turn the latter in the direction of arrow H. Then, before tooth 255-2 of pawl 255 disengages from selector ratchet 251, tooth 255-1 engages and locks ratchet tooth 246-2 of control disk 246 as shown in FIG. 8E. Printing cam 215, hammer 216, and hammer spring 260 (FIG. 6), which have now finished the printing step, bring main clutch portion 249 to a detent step. Since clutch portion 249 is urged in the direction of arrow E by spring 260, control disk 246, which has been shifted by the angle K from the main clutch portion 249 as shown in FIG. 8C, is restored to its original position. Clutch pawl 247 then moves out of engagement with clutch ratchet 245 and the printer mechanism returns to the condition shown in FIG. 8A.

FIG. 9 is a plan view of the overall construction of a third embodiment of the invention in which, instead of being carried on a vertical carriage plate as shown in FIG. 5 with some parts being covered by the carriage housing 218, the printer elements which were then assembled on the vertical carriage plate 219, are now supported on a horizontal carriage plate 318 which is mounted on frame elements 328 and 329 for lateral motion in the direction of arrow $\beta$.

The elements in this figure are numbered in a 300 series and all correspond to their counterparts as numbered to the 200 series used above (FIGS. 5–8). All like numbered elements performed essentially the same functions.

Figure 10:
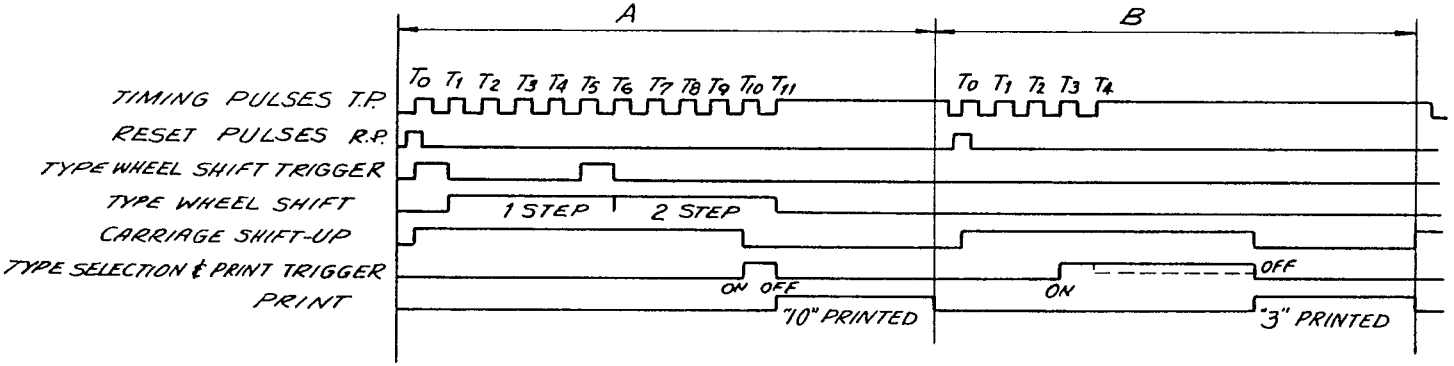
FIG. 10 is a chart illustrating the operating timing of the printer mechanism of the invention.

FIG. 10 is a chart showing the timing of operation of a printer according the present invention. At the top of FIG. 10 are shown a series of timing pulses T.P. and a series of reset pulses R.P. produced by type wheel detector 117 and shift reset detection switch 109. In this example, twelve timing pulses are generated per rotation of the type wheel stack. During stroke period A, a type is selected and printed at a time which is ten pulses behind, in the direction of rotation of the type wheel stack, and which is two shift steps of the type wheel stack, in the direction along the line of character positions. By energizing type wheel shift trigger 305 two times, the axial position of type wheel stack 310 is shifted to produce the two steps; at the same time, stepper motor 321 is energized to shift-up the carriage, moving it to the next character position for typing. The desired type element (shown as "10" in the print line of FIG. 10) is selected by energizing type selection and print trigger 304 after ten pulses. The type is then printed by de-energizing selection and print trigger 304 after the type wheel shift or the carriage shift-up has been completed, which ever is later (in the timing chart of FIG. 11, upon completion of the type wheel shift). In stroke period B, a carriage shift-up is started simultaneously with the rise of the first timing pulse after the previous printing stroke is finished, and a type which is five pulses behind on the same type wheel (shown as "3" on the print line) is selected and printed. Now type selection and print trigger 304 is energized at $TP_3$ (in stroke period B) and remains energized until after the carriage shift-up is completed. The type selection and print trigger is de-energized immediately after the carriage shift-up has been completed, thus effecting printing. Since the print stroke follows completion of the selection stroke, there is no wasteful wait time, and high-speed printing is possible without the use of additional trigger mechanisms. Once selection and print trigger 304 has been energized, the hold current can be reduced as indicated by the broken line in stroke period B, so that the energy consumed by the printer is low.

It will thus be seen that the objects set forth above, among those made apparent from the preceding description, are efficiently atained and, since certain changes may be made in the above composition of matter and in the construction of the apparatus without departing from the spirit and scope of the invention, it is intended that all matter contained in the above description shall be interpreted as illustrative and not in a limiting sense.

What is claimed is:

1. A trigger mechanism for use with a serial printer comprising:

a hammer;

a type wheel stack including at least two print wheels each having a plurality of peripherally positioned types, the type wheel stack being mounted for rotation about an axis and for shifting along the axis;

a prime mover;

first transmission means for rotating the type wheel stack;

second transmission means for shifting the type wheel stack to position a selected type wheel in front of the hammer;

third transmission means for driving the hammer to effect printing;

first switching means for selectively coupling power from the prime mover to the first transmission means;

second switching means for selectively coupling power from the first transmission means to the second transmission means when the first transmission means is being driven;

third switching means for coupling power from the prime mover to the third transmission means;

first trigger means for triggering the first switching means;

second trigger means for triggering the second switching means and;

third trigger means for triggering the third switching means, the first and the third trigger means including a common trigger magnet, the third trigger means being triggerable after the triggering and release of the first trigger means, the second trigger means being independent of the first and third trigger means.

2. The trigger mechanism of claim 1 and further comprising:

detector means coupled to the type wheel stack for detecting the angular position of the type wheel stack to provide an angular position signal for use in controlling selection of a type wheel to be printed.

3. The trigger mechanism of claim 2 and further comprising:

reset signal generating means responsive to the position of the second transmission means to provide a signal indicating that a first of the type wheels has been shifted into position in front of the hammer.

4. The trigger mechanism of claim 1 and further comprising a carriage carrying the hammer, type wheel stack, prime mover, first, second and third trigger means, first, second and third switching means and first, second and third transmission means.

5. The trigger mechanism of claim 1, wherein the first trigger means is triggered upon the energizing of the common trigger magnet, the second trigger means being triggered upon the de-energizing of the common trigger magnet.

6. A print selecting mechanism for use in a serial printer comprising:

carriage means adapted for movement between a series of character positions;

type wheel shaft means rotatably mounted on the carriage means;

motor means mounted on the carriage means;

means for coupling rotary motion from the motor means to the type wheel shaft means;

type wheel stack means mounted on the type wheel shaft means for rotation therewith, the type wheel stack means being axially displaceable along the type wheel shaft means, the type wheel stack means comprising at least two type wheels, each wheel containing a plurality of types; and type wheel selection means coupled to the type wheel shaft means for selectively shifting the type wheel stack means axially on the type wheel shaft means in response to the rotational position of the type wheel shaft means to position a selected type wheel for printing, the type wheel selection means being carried by the carriage means.

7. A print selecting mechanism in accordance with claim 6, wherein the type wheel selection means shifts the type wheel stack axially on the type wheel shaft means in response to the displacement of the type wheel shaft means between respective rotational positions.

8. A print selecting mechanism in accordance with claim 7 and further comprising:

detector means responsive to the angular position of the type wheel shaft means to provide a timing signal representative of the type position on the type wheels.

9. A print selecting mechanism in accordance with claim 2 in which the detector means further comprises:

detector plate means turning in unison with the type wheel shaft means; and pick-up means responsive to rotation of the detector plate means to provide the timing signal.

10. A print selecting mechanism in accordance with claim 6, wherein the timing signal provided by the detector means is also representative of the shift position of the type wheel stack.

11. A print selecting mechanism in accordance with claim 6 and further comprising:

type selection means for selectively stopping the rotation of the type wheel shaft means and therefore of the type wheel stack to position a selected type for printing.

12. A print selecting mechanism in accordance with claim 11 in which the type selection means further comprising:

selector clutch means for interrupting rotation of the type wheel shaft means when a type has been selected.

13. A print selecting mechanism in accordance with claim 11 in which the type selection means further comprises:

ratchet wheel means on the type wheel shaft means; and electrically actuated pawl means interactive with the ratchet wheel means for selectively engaging the ratchet wheel means to stop the type wheel shaft.

14. A print selecting mechanism in accordance with claim 11 in which the type selection means is carried by the carriage means.

15. A print selecting mechanism in accordance with claim 6 in which the type wheel stack is shiftable on the type wheel shaft means in a direction along the series of character positions.

16. A print selecting mechanism in accordance with claim 6 in which the means for coupling rotation of the motor means to the type wheel shaft means comprises reduction gears.

17. A print selecting mechanism in accordance with claim 6 and further comprising:

hammer means supported on the carriage means, the hammer means being movable to strike a selected type in the type in the type wheel stacks;

hammer driving means for moving the hammer means; and print clutch means responsive to a control signal for coupling rotary motion from the motor means to actuate the hammer driving means.

18. A print selecting mechanism in accordance with claim 17 and further comprising:

type selection means responsive to the control signal to stop rotation of the type wheel stack at a selected type so as to position the selected type for printing.

19. A print selecting mechanism in accordance with claim 17 in which the hammer means comprises a cam follower means and in which the hammer driving means comprises a cam means to which power is coupled from the motor means through the print clutch means.

20. A print selecting mechanism in accordance with claim 6 in which the carriage means further comprises a vertical carriage plate, the type wheel stack being disposed on one side thereof, the print selecting mechanism further comprising:

hammer means supported on the carriage plate and extending within the type wheel stack for striking a type; and hammer driving means for coupling rotation from the motor means to the hammer means.

21. A print selecting mechanism in accordance with claim 20, and further comprising:

type selection means for selectively stopping rotation of the type wheel stack at a selected type to position the selected type for printing, the hammer driving means, type selection means and type wheel selection means all being carried on the carriage means.

22. A print selecting mechanism in accordance with claim 21 and further comprising:

housing means coupled to the carriage plate for enclosing the type selection means, the hammer driving means and that part of the type wheel selection means which is on said other side of the carriage plate.

23. A print selecting mechanism in accordance with claim 22, in which the type wheel selection means includes shift clutch means for selectively coupling the type wheel selection means to the type wheel shaft means for the axial displacement of the type wheel stack in response to the rotation of the type wheel shaft means, the shift clutch means being enclosed by the housing means.

24. A print selecting mechanism for use in a serial printer comprising:

carriage means adapted for movement between a series of character positions;

type wheel shaft means rotatably mounted on the carriage means;

motor means mounted on the carriage means;

means for coupling rotary motion from the motor means to the type wheel shaft means;

type wheel stack means comprising at least two type wheels, each wheel containing a plurality of types, the type wheel stack means mounted on the type wheel shaft means for rotation therewith, the type wheel stack means being axially displaceable along the type wheel shaft means;

type wheel selection means for displacing the type wheel stack means axially on the type wheel shaft means to position a selected type wheel for printing in response to the rotational position of the type wheel shaft means, the type wheel selection means further comprising:

cam follower means coupled to the type wheel stack means for displacing the type wheel stack means on the type wheel shaft means;

cam means responsive to rotation of the type wheel shaft means when coupled thereto to move the cam follower means; and shift clutch means for selectively coupling the cam means to the type wheel shaft means to rotate the cam means for type wheel selection.

25. A print selecting mechanism in accordance with claim 24 and further comprising:

detent means for stabilizing the cam means at the desired axial positions of the type wheel stack, whereby the type wheel stack is accurately positioned in the axial direction for printing.

26. A print selecting mechanism for use in a serial printer comprising:

carriage means adapted for movement between a series of character positions;

type wheel shaft means rotatably mounted on the carriage means;

motor means mounted on the carriage means;

means for coupling rotary motion from the motor means to the type wheel shaft means;

type wheel stack means comprising at least two type wheels, each wheel containing a plurality of types, the type wheel stack mounted on the type wheel shaft means for rotation therewith, the type wheel stack means being axially displaceable along the type wheel shaft means;

type wheel selection means for displacing the type wheel stack means axially on the type wheel shaft means to position a selected type wheel for printing in response to the rotational position of the type wheel shaft means, the type wheel selection means further comprising:

shift clutch means responsive to a control signal to selectively couple the type wheel selection means to the type wheel shaft means for the axial displacement of the type wheel stack in response to the rotation of the type wheel shaft means.

27. A print selecting mechanism in accordance with claim 26 in which the shift clutch means further comprises:

clutch disk means having detent means equal in number to the number of type wheels in the type wheel stack; and shift control pawl means interacting with the detent means, the shift control pawl means being responsive to the control signal to stop delivery of power to the type wheel selection means when the type wheel stack has reached a selected axial position.

28. A print selecting mechanism for use in a serial printer comprising:

carriage means adapted for movement between a series of character positions;

type wheel shaft means rotatably mounted on the carriage means;

motor means mounted on the carriage means;

means for coupling rotary motion from the motor means to the type wheel shaft means;

type wheel stack means comprising at least two type wheels, each wheel containing a plurality of types, the type wheel stack mounted on the type wheel shaft means for rotation therewith, the type wheel stack means being axially displaceable along the type wheel shaft means;

type wheel selection means for displacing the type wheel stack means axially on the type wheel shaft means to position a selected type wheel for printing in response to the rotational position of the type wheel shaft means;

printer frame means including slide means on which the carriage means is mounted for movement, the carriage means being movable to and from a stand-by position;

means for selectively coupling the type wheel selection means to the type wheel shaft means to receive rotary power therefrom;

paper feed drive gear means on the carriage means and coupled to the type wheel selection means for receiving rotary power therefrom;

paper feed means on the print frame means; and paper feed transmission gear means coupled to the paper feed means, the paper feed transmission gear means being located at the stand-by position of the carriage means to engage the paper feed drive gear means, whereby when the carriage means is at stand-by position, rotary power from the type wheels selection means is coupled to the paper feed means.

29. A print selecting mechanism for use in a serial printer comprising:

carriage means adapted for movement between a series of character positions, the carriage means including a vertical carriage plate;

type wheel shaft means rotatably mounted on the carriage means;

motor means mounted on the carriage means;

type wheel stack means comprising at least two type wheels, the type wheel stack means mounted on the type wheel shaft means for rotation therewith, the type wheel stack means being axially displaceable along the type wheel shaft means, the type wheel stack means being disposed on one side of the vertical carriage plate;

means on the other side of the vertical carriage plate from the type wheel stack means for selectively coupling rotary motion from the motor means to the type wheel shaft means;

hammer means supported on the carriage plate and extending within the type wheel stack for striking a character;

hammer driving means at least partially on the other side of the vertical carriage plate for coupling rotation from the motor means to the hammer means and;

a type wheel selection means for shifting the type wheel stack means axially on the type wheel shaft means to position a selected type wheel for printing, the type wheel selection means being located at least partially on the other side of the vertical plate.

30. A print selecting mechanism for use in a serial printer comprising:

carriage means adapted for movement between a series of characters positions;

type wheel shaft means mounted on the carriage means;

motor means mounted on the carriage means;

selection clutch means for coupling rotary motion from the motor means to the type wheel shaft means;

type wheel stack means comprising at least two type wheels, each wheel containing a plurality of types, the type wheel stack means mounted on the type wheel shaft means for rotation therewith, the type wheel stack means being axially displaceable along the type wheel shaft means;

type wheel selection means for displacing the type wheel stack axially on the type wheel shaft means to position a selected type wheel for printing in response to the rotational position of the type wheel shaft means;

hammer means supported on the carriage means, the hammer means movable to strike the selected type;

hammer driving means for moving the hammer means;

print clutch means for coupling power from the motor means to the hammer driving means;

selection lever means for causing the selection clutch means to be disengaged to stop coupling rotary motion to the type wheel shaft means; and actuation lever means for actuating the print clutch means when the selection clutch means has been disengaged.

31. A print selecting mechanism for use in a serial printer comprising:

carriage means adapted for movement between a series of characters positions;

type wheel shaft means rotatably mounted on the carriage means;

motor means mounted on the carriage means;

selection clutch means for selectively coupling rotary motion from the motor means to the type wheel shaft means;

type wheel stack means comprising two type wheels, each type wheel containing a plurality of types;

the type wheel stack means being mounted on the type wheel shaft means for rotation therewith, the type wheel stack means being axially displaceable along the type wheel shaft means;

type wheel selection means for displacing the type wheel stack axially on the type wheel shaft means to position a selected type wheel for printing in response to the rotational position of the type wheel shaft means;

hammer means supported on the carriage means, the hammer means movable to strike the selected type;

hammer driving means for moving the hammer means;

print clutch means for coupling power from the motor means to the hammer driving means;

selection lever means for disengaging the selection clutch means from the type wheel shaft means;

actuation lever means for actuating the print clutch means when the selection clutch means has been disengaged;

trigger magnet means rotating with the print wheel shaft means; and trigger plate means responding to magnetization of the trigger magnet means to actuate the selection lever means and thereafter responding to the demagnetization of the trigger means to enable the actuation of the actuation lever means.

32. The print selecting mechanism of claim 31 and further comprising:

bias means for biasing the actuation lever means from a first position to a second position at which said print clutch means is energized by the motor means after de-energization of the trigger magnet means, the trigger plate means displacing the actuation lever means to said first position upon energization of the trigger magnet means.

33. A print selecting mechanism in accordance with claim 31 and further comprising:

planetary reduction gear means driven by the motor, the planetary reduction gear means comprising planetary gears, a carrier of the planetary gears for coupling rotation to the type wheel shaft means and an internal gear for coupling rotation to the print clutch means.

34. A print selecting mechanism in accordance with claim 33 and further comprising:

ratchet means in the outer periphery of the internal gear, the ratchet means being engaged by the actuation lever means when it is in the first position to prevent rotation of the internal gear.

35. The print selecting mechanism of claim 34 and further comprising:

another ratchet means coupled to and rotating with the internal gear;

a print clutch pawl means carried on the print clutch means for engaging the other ratchet means; and control disk means rotating with the print clutch means and the print clutch pawl means for bringing the print clutch pawl means into engagement with the other ratchet means, the control disk means being prevented from movement by the actuation lever means when the actuation lever means is in the first position and allowed to move when the actuation lever means is in the second position whereby the clutch pawl is brought into engagement with the other ratchet means and the print clutch means is energized.

* * * * *